United States Patent [19]

Abraham

[11] 4,245,482

[45] Jan. 20, 1981

[54] GLASS DOOR MERCHANDISER

[75] Inventor: Fayez F. Abraham, Niles, Mich.

[73] Assignee: Tyler Refrigeration Corporation, Niles, Mich.

[21] Appl. No.: 25,473

[22] Filed: Mar. 30, 1979

[51] Int. Cl.[3] ..... A47F 3/04; F25D 21/10

[52] U.S. Cl. ..... 62/256; 62/282

[58] Field of Search ..... 62/248, 256, 272, 282

[56] References Cited

U.S. PATENT DOCUMENTS

| | | | |
|---|---|---|---|
| 2,622,954 | 12/1952 | Merkle | 62/256 X |
| 3,226,945 | 1/1966 | Spencer | 62/256 |
| 3,403,525 | 10/1968 | Beckwith et al. | 62/282 X |
| 3,850,003 | 11/1974 | Beckwith et al. | 62/256 |
| 3,937,033 | 2/1976 | Beckwith et al. | 62/282 X |
| 4,026,121 | 5/1977 | Aokage et al. | 62/256 X |
| 4,072,488 | 2/1978 | Johnston | 62/282 |
| 4,144,720 | 3/1979 | Subera et al. | 62/256 |

*Primary Examiner*—Lloyd L. King

*Attorney, Agent, or Firm*—LeBlanc, Nolan, Shur & Nies

[57] ABSTRACT

A refrigerated display case having a display section within a cabinet and movable door covering the access opening to such display section. The cabinet has top, bottom, rear and side walls with an opening in its front, which opening is covered by the door. An air conduit extends along the top, bottom and rear walls of the cabinet. The air conduit has an outlet opening and an inlet opening at opposite ends thereof with the openings being in alignment so that air leaving the outlet opening will be directed towards and received by the inlet opening thereby forming an air curtain across the front opening of the cabinet along the path inside the door. During a refrigeration cycle of operation of the display case, refrigerated air is circulated through the air conduit and a refrigeration mechanism arranged within the conduit by a positive pressure air flow so as to establish a refrigerated air band and a refrigerated air curtain across the front opening in the cabinet. During a defrost cycle of operation, the refrigeration mechanism is turned off and ambient air is circulated through a substantial portion of the air conduit. Such ambient air serves to defrost the refrigeration mechanism and the interior of the air conduit. The ambient air, however, is prevented from flowing into the display section of the display case.

14 Claims, 3 Drawing Figures

GLASS DOOR MERCHANDISER

BACKGROUND OF THE INVENTION

The present invention primarily relates to a glass door merchandiser type of refrigerated display case. While reference is made herein to the use of glass doors since those are the types of doors most frequently utilized, other types of doors can be used within the scope of the present invention. In addition, the term refrigerated, in accordance with the present invention, is intended to incorporate both those cases maintained at a temperature either at or in excess of 32° F., such as display cases utilized for displaying milk and fresh foods, and those cases maintained below 32° F., such as frozen food cases.

In the operation of all types of refrigerated display cases, it is desirable to include a system capable of automatically defrosting the display case. The defrost cycle can be actuated either at set periodic times or when the frost buildup within the system has reached a certain predetermined level. Such systems are typically thermostatically controlled so as to switch from a refrigeration cycle to a defrost cycle of operation. In this manner of operation, it is possible to avoid any significant frost buildup within the display case.

Typically within the prior art, there have been three different approaches employed for defrosting refrigerated display cases. The three approaches include: utilizing electric resistance heaters; passing a compressed gaseous refrigerant through the refrigeration coils; and, circulating ambient air through the air conduit. Due to the increasing cost of energy in recent years, efforts have been made to place more emphasis on the utilization of ambient air defrost systems in place of the electrical resistence heaters or compressed gaseous refrigerant defrost systems.

One type of system that employs ambient air during the defrost cycle is exemplified by those embodiments illustrated in U.S. Pat. Nos. 3,403,525, 3,850,003 and 3,937,033, all to Beckwith,et al. These systems use fans separate and distinct from the main circulating fans. The additional fans are turned on only during the defrost cycle of operation for pulling ambient air from outside of the display case directly into the air conduits. A second type of system is illustrated in U.S. Pat. No. 3,082,612 to Beckwith, which system draws ambient air into the main circulation path through ports located in the lower front panel of the refrigerated display case. Such ports are normally closed during the refrigeration cycle and are opened during the defrosting cycle. The Beckwith, et al. 3,850,003 patent indicates that the concepts described in U.S. Pat. Nos. 3,082,612 and 3,403,525 did not prove to be practical and hence were not commercially feasible.

Another type of ambient air defrosting system is shown in U.S. Pat. No. 4,144,720 to Subera, et al., which is assigned to the same assignee as the present application. In the foregoing patent application, an open front refrigerated display case having primary and secondary air conduits is disclosed. In this system, the direction of air flow within one of the conduits is reversed, for example, by the use of reversible fans for ambient air defrost. U.S. Pat. No. 4,026,121 to Aokage, which illustrates an open front display case, and U.S. Pat. No. 4,120,174 to Johnston, which illustrates an open top display case, also disclose reverse ambient air flows for defrosting.

In those ambient air defrost systems disclosed in the above-noted patents which use a reverse air flow, during the defrost cycle of operation, the air is expelled from the air conduit through the air inlet opening and ambient air is drawn into the air conduit through the outlet opening of the air conduit. Such an arrangement, however, cannot be used in a glass door type merchandiser refrigerated display case, since the front opening in the cabinet is covered by the doors. Thus, in order to employ an ambient air defrost system, a different type of system had to be developed In seeking to employ ambient air defrost techniques in a glass door case, systems have been developed for drawing in air over a limited portion of the air conduit by opening flaps to the conduit, which flaps are arranged so as to astraddle the evaporator coils of the refrigeration mechanism; such systems are disclosed in U.S. Pat. Nos. 3,226,945 to Spencer and 4,072,488 to Johnston. The patent to Spencer illustrates a plurality of different embodiments of open top refrigerated display cases, both of a single shelf and multi-shelf type, in which a glass cover is arranged over the opening in the display case. During the refrigeration cycle of operation, air is drawn through the evaporator coils by a negative pressure created upstream of the coils; such air after being refrigerated is circulated through the air conduit and into the display section of the case. The patent to Johnston discloses a glass door type merchandiser display case in which air is circulated through the air conduit and through the evaporator coils arranged within the air conduit in such a direction that cold air enters from the bottom of the opening in the cabinet and after passing across such opening is then drawn back into the air conduit by an air inlet located at the top of the opening in the cabinet.

SUMMARY OF THE INVENTION

An object of the present invention is to provide an improved open front refrigerated display case that has a movable door covering the access opening into the display section of the display case.

Another object of the present invention is to provide a refrigerated display case having a movable door covering the front access opening with an improved ambient air defrost system.

A further object of the present invention is to provide a refrigerated display case having a movable door covering its front access opening that provides for a more efficient ambient air defrost operation than previously known display cases of this type.

Still another object of the present invention is to provide an improved glass door merchandiser refrigerated display case utilizing an ambient air defrost system.

A still further object of the present invention is to provide a glass door merchandiser refrigerated display case utilizing an ambient air defrost system where the air is circulated through the evaporator coils during a refrigeration cycle by a positive pressure air flow.

A still further object of the present invention is to provide a glass door merchandiser refrigerated display case utilizing an ambient air defrost system where during the defrost operation ambient air is circulated through a substantial portion of the air conduit while such ambient air is substantially prevented from entering the display section of the display case.

These objectives are achieved by the provision of a glass door type refrigerated display case in accordance with the present invention and the operation of such a case in accordance with the present invention. The refrigerated display case of the present invention has a cabinet with top, bottom, rear and side walls with an opening in its front and a display section within the cabinet. At least one door, which is generally a glass door, covers the front opening. The door is movable so as to enable access through the front opening to products within the display section of the display case. An air conduit extends along the top, bottom and rear walls of the cabinet and has an outlet opening and an inlet opening at opposing ends thereof. The outlet opening and the inlet opening are arranged in alignment so that air leaving the outlet opening will be directed towards and received by the inlet opening so as to form an air curtain across the front opening of the cabinet along a path inside of the door. In the air conduit, there are a refrigeration mechanism, which is typically either a single or plurality of evaporator coils, and at least one fan for circulating air through the conduit. The evaporator coils are located upstream of the fan so that air is circulated through the coils by a positive pressure air flow. During a defrost operation, the evaporator coils are turned off and ambient air is drawn into the air conduit and circulated through a substantial portion of the conduit, including that portion along the rear wall of the cabinet and that portion containing the evaporator coils, thereby defrosting the evaporator coils in the interior of the air conduit. Such ambient air, however, is substantially prevented from flowing into the display section of the display case.

The air outlet and inlet openings of the air conduit are aligned along a substantially vertical path across the front opening of the cabinet with the air outlet opening being near the top wall of the cabinet. Thus, during a refrigeration cycle of operation, a curtain of refrigerated air extends in a substantially vertical direction flowing from top to bottom across the front opening of the cabinet. During the defrost cycle of operation, the direction of air flow through the conduit is reversed as compared to the direction of air flow during a refrigeration cycle of operation.

In order to prevent the flow of ambient air into the display section of the display case, blocking mechanisms are provided for controlling the air flow. These blocking mechanisms are provided in conjunction with two apertures within the case that are in communication with the air conduit. One of these apertures is located at the top of the display case while the other aperture is located along the bottom of the display case. The apertures are disposed on opposite sides of both the air circulating fan and the evaporator coils. When the display case is switched into a defrost cycle of operation, each of the apertures is opened and simultaneously a blocking member is extended into the air conduit for preventing the flow of air past the location of such blocking member. The direction of air flow through the air conduit is then reversed so that ambient air is drawn into the air conduit through the aperture in the top portion of the display case and such air is expelled through the aperture in the bottom of the display case. Thus, the ambient air is drawn in a reversed direction by a negative pressure through the evaporator coils. In addition, it is possible to increase the quantity of air flowing through the air conduit during the defrost cycle of operation as compared to the air flow during a refrigeration cycle of operation in order to speed up the defrost operation. This increase in air flow can be on the order of 25 to 50 percent.

During the refrigeration cycle of operation, the apertures in communication with the air conduit are covered by closure members thereby preventing air flow out of the case. During a defrost cycle of operation, however, the closure members are moved into a position for opening such apertures. In addition, during the defrost cycle of operation, blocking members are moved into a position for blocking air flow through the conduit. These blocking members, however, are moved into a position for enabling air flow through the conduit during a refrigeration cycle of operation.

During the refrigeration operation, there is often a buildup of condensation at the location of the air inlet of the air conduit. This buildup of condensation occurs since the air moving across the front opening in the cabinet picks up moisture from the inside display section, which moisture is picked up from the ambient air when the door of the display case is opened. The buildup of condensation can and often does result in accumulation of a frost buildup which blocks at least a portion if not the entire inlet opening, thereby decreasing the efficiency of operation of the display case. Inasmuch as the ambient air during defrost is not being circulated through the inlet opening, the defrosting system will not serve to eliminate any frost buildup at the inlet opening. Consequently, some other mechanism must be provided in order to eliminate this buildup of frost at the inlet opening. For this purpose, a liquid refrigerant line can be arranged in the area of the inlet opening. Such line carries the liquid refrigerant before it is sent to the evaporator. Since such refrigerant is warmer than the refrigerated air, it will serve to maintain the temperature of the air in the area immediately surrounding the inlet opening at a level above the dew point, thereby minimizing the buildup of condensation and frost in this area. The use of such liquid lines systems is generally disclosed in U.S. Pat. No. 3,371,503 to Perez.

In operating the refrigerated display case of the present invention, air is circulated through the air conduit in a direction so that the refrigerated air is propelled through the refrigeration mechanism by a positive pressure air flow and such air is circulated through the conduit so as to flow in a substantially vertical direction across the opening in the cabinet in a direction flowing from the top to the bottom of such opening. Such air flow creates a refrigerated air curtain lying along a substantially vertical path with such certain being located immediately inside of the movable door of the display case. During a defrost cycle of operation, the direction of air flow through the air conduit is reversed and ambient air is drawn into the air conduit, which ambient air serves to defrost the interior of the conduit and the refrigeration mechanism. Such ambient air, however, is prevented from reaching either the air outlet or air inlet openings of the conduit and thus is blocked from the display section of the cabinet.

While reference is made herein to the utilization of a fan for circulating air through the air conduit, it is noted that more than one fan may be utilized within the display case. The number of fans employed depends on the width of the display case. Typically, an eight foot wide display case utilizes two air circulating fans and a twelve foot case would use three air circulating fans. The number of fans, however, can be varied depending on the width of the case and the sizes of the fans. Likewise, the number of doors covering the front opening of the cabinet would vary depending on the width of the display case, with more doors being utilized for wider display cases. The doors on the case can be either attached by hinges to the case or mounted so as to be slidable along tracks in the case.

DESCRIPTION OF THE PREFERRED EMBODIMENTS

Figure 1:
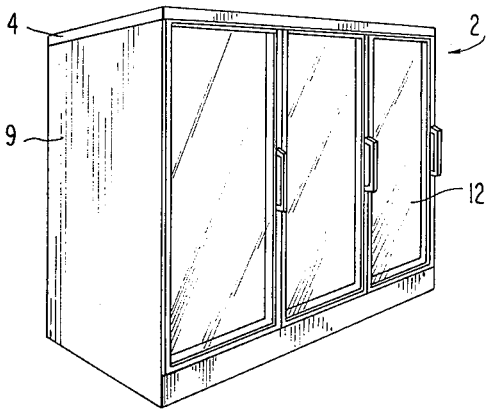
FIG. 1 is a perspective view of a glass door merchandiser type of refrigerated display case in accordance with the present invention.
Figure 2:
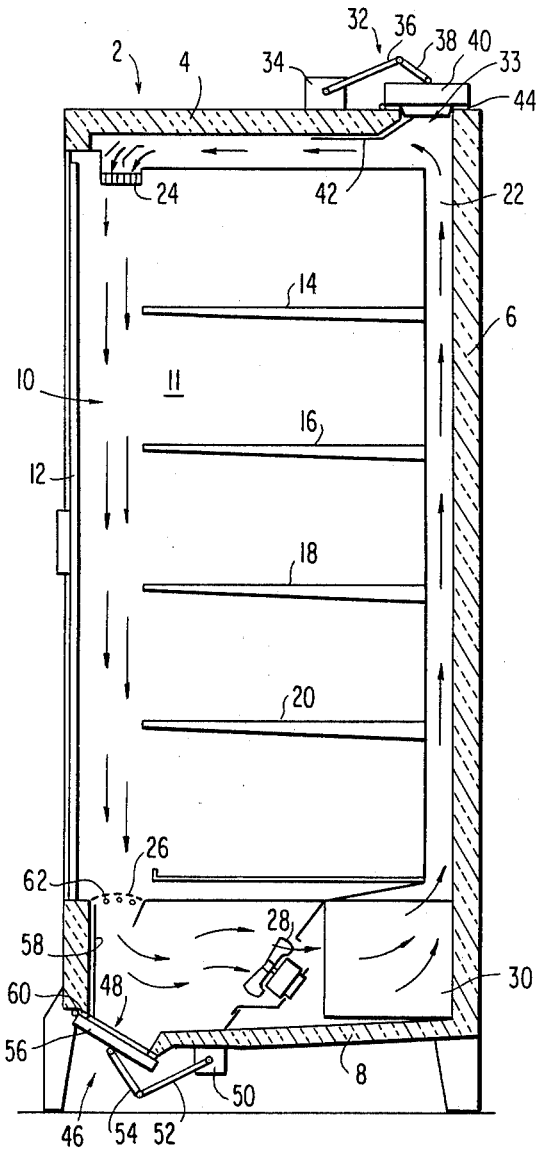
FIG. 2 is a side cross-sectional view of the refrigerated display case illustrated in FIG. 1 when such display case is being operated during a refrigeration cycle of operation.
Figure 3:
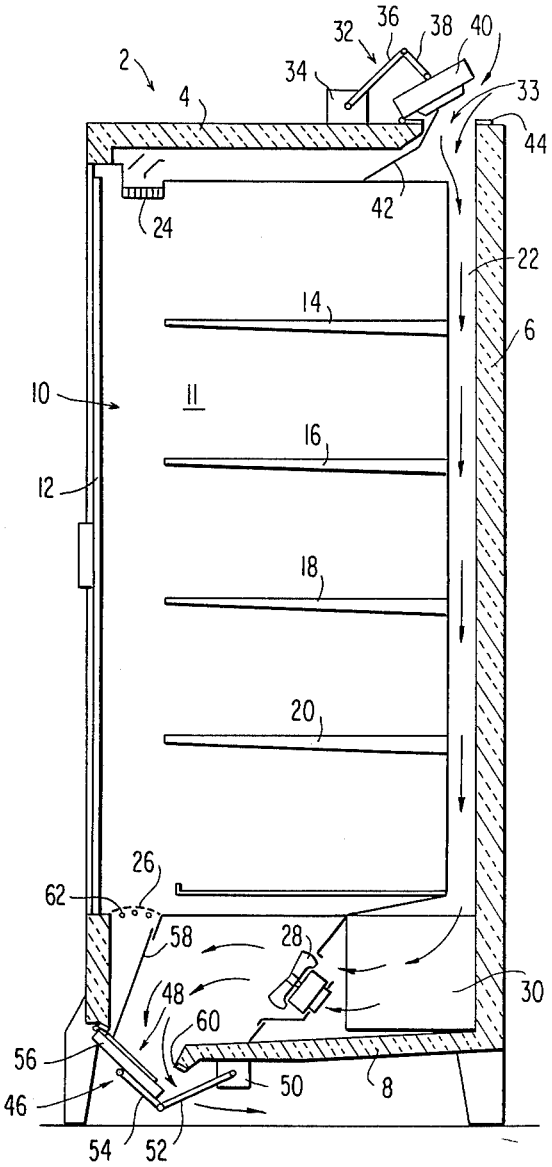
FIG. 3 is a view of the refrigerated display case similar to that shown in FIG. 2, except that the display case is being operated in a defrost cycle of operation.

A refrigerated display case 2 has a top wall 4, a rear wall 6, a bottom wall 8 and two side walls 9. Display case 2 has an opening 10 in its front which is covered by either a single or a plurality of glass doors 12. Such a display case, which is shown in a perspective view in FIG. 1 and in cross-sectional views in FIGS. 2 and 3, is typically referred to as a glass door merchandiser. A glass door merchandiser refrigerated display case can be used for storing either fresh foods, such as dairy products, or frozen foods.

The interior of the display case has a display section 11 in which there are arranged a plurality of display shelves 14, 16, 18 and 20. Access to the refrigerated products on the display shelves is obtained by opening one of the doors 12 and reaching into the case through opening 10.

Surrounding display section 11 is an air conduit 22. Air conduit 22 extends along top wall 4, a rear wall 6 and bottom wall 8 of the display case. Conduit 22 has an outlet opening 24 arranged near the top of the display case and an inlet opening 26 arranged near the bottom of the display case. Outlet opening 24 and inlet opening 26 are arranged in alignment so that air expelled through opening 24 is directed along a substantially vertical path towards and into inlet opening 26 so as to form a vertically extending air curtain across opening 10 in the front of display case 2. This air curtain is positioned inside of glass door 12.

Arranged within air conduit 22 is at least one fan 28 and an evaporator coil 30, or a plurality of such evaporator coils. Both fan 28 and evaporator coil 30 are arranged in the bottom portion of the air conduit. Fan 28 is positioned upstream of evaporator coil 30 so that the fan creates a positive pressure air flow through the coils during the refrigeration cycle of operation. Such a positive pressure air flow provides for better and more efficient air circulation than if the fan was located downstream of the coil, where it would rely on a suction or drawing action of the air through the coil.

During a refrigeration cycle of operation of display case 2, air is circulated by fan 28 through air conduit 22 so as to pass through evaporator coil 30. As the air passes through evaporator coil 30 it is refrigerated. Such refrigerated air is then expelled out of conduit 22 through outlet opening 24 along a path across opening 10 and back into inlet opening 26, where such air is then recirculated and again refrigerated.

It is intended that the display case of the present invention, such as represented by the exemplary embodiment illustrated in the drawings employ ambient air for purposes of defrosting both the interior of air conduit 22 and evaporator coil 30. Inasmuch as the front of the display case is covered by glass door 12, a mechanism must be provided for enabling ambient air from outside of the display case to be drawn into the case and passed through the conduit without such air entering display section 11. For this reason, the display case is provided with two apertures, 33 and 48. During the refrigeration cycle of operation, each of these apertures is closed by an appropriate closure member which will be described below.

First considering aperture 33 in top wall 4 of the display case, this aperture is closed by a top gate mechanism 32 during the refrigeration cycle of operation. Gate mechanism 32 includes a motor 34, a first arm 36 and a second arm 38. At the end of arm 38 is a closure member 40. The gate mechanism in its normal position has arms 36 and 38 properly arranged so that closure member 40 is inserted into aperture 33 and sits against seat 44 in the top of the display case. Attached to closure member 40 is a blocking member 42. During the refrigeration cycle of operation, blocking member 42 allows air to pass through the upper portion of the air conduit so as to be expelled through outlet opening 24. The positions of the gate mechanism and the associated elements during a refrigeration cycle of operation are shown in FIG. 2. During the defrost cycle of operation, motor 34 pivots arms 36 and 38 so as to lift closure member 40 up and away from aperture 33, thereby allowing air to be drawn into conduit 22 through aperture 33 when the air flow direction is reversed. Simultaneously with the upward movement of closure member 40, blocking member 42 is pivoted into a position for substantially blocking the air flow through the conduit so as to prevent air from the display section from being drawn into air conduit 22 through outlet opening 24. Thus, the ambient air which is drawn into conduit 22 is prevented from being expelled through outlet opening 24 into display section 11 of display case 2.

Now considering aperture 48 in the bottom of display case 2, it can be seen that another gate mechanism 46 is provided for preventing air from leaving such aperture during the refrigeration cycle of operation. Gate mechanism 46 includes a motor 50, a first arm 52, a second arm 54 and a closure member 56. In the normally closed position of gate mechanism 46, closure member 56 is inserted into aperture 48 and is in contact with seat 60. During a defrost cycle of operation, however, motor 50 is actuated so as to move arm 52 and 54 and hence closure member 56 so as to open aperture 48. By either positioning fan 28 in an appropriate location or by utilizing a blocking member 58 which is attached to closure member 56, the ambient air flowing in a reverse direction in air conduit 22 can be directed out of the conduit through aperture 48 and such ambient air is substantially prevented from reaching air inlet 26.

Thus, during a defrost cycle of operation, closure members 40 and 56 are pivoted out of their respective apertures 33 and 48. The operation of fan 28 is reversed so that air flows through air conduit 22 in a direction opposite the air flow during a refrigeration cycle. With this reverse flow of air, ambient air from outside of the display is drawn in through aperture 33 into conduit 22.

The ambient air flows along the portion of the conduit adjacent to the rear wall of display case 2. Such ambient air then flows through evaporator coil 30 and out of aperture 48 in the bottom of the display case. The ambient air serves to defrost both the interior of conduit 22 and evaporator coil 30.

Since the ambient air is substantially prevented from reaching inlet opening 26, it is possible for condensation to accumulate on the grill work at that opening. Such condensation can eventually lead to a buildup of frost, thereby blocking the openings in the grill work. In order to minimize such a condition, liquid lines 62 can be provided adjacent each of the openings of the grill work at inlet opening 26. Such liquid lines contain liquid refrigerant which is in the process of being carried towards the evaporator coil. Since such liquid refrigerant is warmer than the air passing through inlet opening 26, the liquid refrigerant serves to eliminate the buildup of condensation and frost on the grill covering the inlet opening.

The present invention may be embodied in other specific forms without departing from the spirit or essential characteristics thereof. The present embodiments are presented merely as illustrative and not restrictive, with the scope of the invention being indicated by the attached claims rather than the foregoing description. All changes which come within the meaning and range of equivalency of the claims are therefore intended to be embraced therein.

What is claimed is:

1. A refrigerated display case having a display section therein comprising:

a cabinet having top, bottom, rear and side walls and an opening at its front;

at least one door covering said front opening, said door being movable for enabling access through said front opening to products within said display section of said display case;

an air conduit extending along said top, bottom and rear walls and having an outlet opening and an inlet opening at opposing ends thereof, said outlet opening and said inlet opening being arranged in alignment so that air leaving said outlet opening will be directed towards and received by said inlet opening and form an air curtain across said front opening along a path inside of said door;

an air band establishing means for establishing a flow of refrigerated air through said air conduit during a refrigeration cycle of operation, said air band establishing means including refrigeration means and means for creating a positive pressure air flow through said refrigeration means; and defrost means for defrosting said display case when said display case is operated in a defrost cycle of operation, said defrost means causing ambient air to pass through a substantial portion of said air conduit, including that portion of said air conduit located along said rear wall of said cabinet of said display case, said defrost means causing the ambient air to flow in a reverse direction with respect to the air flow during a refrigeration cycle of operation and passing such ambient air through said refrigeration means for defrosting said refrigeration means and said air conduit while substantially preventing any ambient air flow into said display section of said display case.

2. A refrigerated display case according to claim 1 further comprising control means for selectively switching said display case between a refrigeration cycle of operation and a defrost cycle of operation.

3. A refrigerated display case according to claim 1 or 2 wherein said outlet opening and inlet opening are aligned along a substantially vertical path with said outlet opening being near said top wall of said cabinet so that during a refrigeration cycle of operation a curtain of refrigerated air is formed so as to extend in a substantially vertical direction flowing from top to bottom across said front opening in said cabinet.

4. A refrigerated display case according to claim 3 wherein said door is a glass door.

5. A refrigerated display case according to claim 3 wherein said defrost means includes means for blocking the air flow through said air conduit from reaching said air outlet opening and said air inlet opening during the defrost cycle of operation.

6. A refrigerated display case according to claim 5 wherein said cabinet has apertures in its top and bottom portions with said apertures being in communication with said air conduit and further comprising gate means for normally closing said apertures during a refrigeration cycle of operation so that air is prevented from entering or leaving through said apertures during a refrigeration cycle of operation, and during a defrost cycle of operation said gate means moving in a direction for opening said apertures for enabling air to pass through said apertures.

7. A refrigerated display case according to claim 6 wherein said gate means includes movable closure members movable between a closed position for covering said apertures during a refrigeration cycle of operation and an open position for opening said apertures during a defrost cycle of operation and blocking members movable between an open position for allowing air flow through said air conduit during a refrigeration cycle of operation and a closed position for blocking air flow through said air conduit from reaching said air outlet and said air inlet openings during a defrost cycle of operation.

8. A refrigerated display case according to claim 3 wherein said refrigeration means includes a set of evaporator coils, said evaporator coils being located in a portion of said air conduit along said bottom of said display case.

9. A refrigerated display case according to claim 3 further comprising means for substantially minimizing condensation, and frost build up in the area of said inlet opening.

10. A refrigerated display case according to claim 9 wherein said means for substantially minimizing condensation and frost build up include liquid lines for carrying liquid refrigerant used in said refrigeration means and said liquid lines are arranged in the area of said inlet opening.

11. A method of operating a refrigerated display case having:

a cabinet with top, bottom, rear and side walls, an interior display section, and an opening at its front for enabling access to products within said display section; at least one door covering the front opening and being movable for enabling access through the front opening, an air conduit extending along the top, bottom and rear walls and having an outlet opening and an inlet opening at opposing ends thereof, with the outlet opening and the inlet opening being arranged in alignment so that air leaving the outlet opening will be directed towards and received by the inlet opening; and an evaporator coil being arranged within the air conduit;

the method comprising the steps of:

selectively operating the display case in a refrigeration cycle of operation and a defrost cycle of operation;

during a refrigeration cycle of operation, circulating air through the air conduit so that air is expelled from the outlet opening and received by the inlet opening so as to form an air curtain across the front opening in the cabinet along a path inside of the door, propelling the air through an evaporator coil and refrigerating such air by using the evaporator coil as the air is circulated through the air conduit; and during a defrost cycle of operation; causing unrefrigerated ambient air to pass through a substantial portion of the air conduit, including that portion located along the rear wall of the cabinet, causing such ambient air to flow through the air conduit in a direction opposite the direction of air flow during a refrigeration cycle of operation, and preventing such ambient air from entering the display section of the cabinet.

12. A method according to claim 11 wherein the curtain of refrigerated air extends in a substantially vertical direction across the front opening in the cabinet.

13. A method according to claim 11 further comprising the step of minimizing condensation and frost build up in the area of the inlet opening.

14. A method according to claim 11 wherein the quantity of air flowing through the air conduit during a defrost cycle of operation is 25 to 50% greater than the air flow during the refrigeration cycle of operation.

* * * * *

UNITED STATES PATENT AND TRADEMARK OFFICE

CERTIFICATE OF CORRECTION

PATENT NO. : 4,245,482

DATED : January 20, 1981

INVENTOR(S) : Fayez F. Abraham

It is certified that error appears in the above—identified patent and that said Letters Patent is hereby corrected as shown below:

The term of this patent subsequent to January 6, 1998 has been disclaimed.

Signed and Sealed this

*Seventh* Day of *April 1981*

[SEAL]

*Attest:*

RENE D. TEGTMEYER

*Attesting Officer* *Acting Commissioner of Patents and Trademarks*